US005567896A

United States Patent [19]

Gottschall

[11] Patent Number: 5,567,896

[45] Date of Patent: Oct. 22, 1996

[54] STRING INSTRUMENT WITH SOUND AMPLIFICATION

[76] Inventor: Peter Gottschall, Mörikestrasse 5, D-88524 Uttenweiler, Germany

[21] Appl. No.: 501,787

[22] Filed: Jul. 13, 1995

[30] Foreign Application Priority Data

Dec. 23, 1994 [CH] Switzerland ..... 03913/94
Jun. 2, 1995 [CH] Switzerland ..... 01619/95

[51] Int. Cl.[6] ..... G10D 3/02
[52] U.S. Cl. ..... 84/294
[58] Field of Search ..... 84/275, 291, 294

[56] References Cited

U.S. PATENT DOCUMENTS 610,905 9/1898 Sommer ..... 84/294
794,333 7/1905 Appelberg ..... 84/294

*Primary Examiner*—Patrick J. Stanzione
*Attorney, Agent, or Firm*—Karl Hormann

[57] ABSTRACT

A musical string instrument (1) having a resonator (3) including a belly (5) and a back (7) connected by a side (9) and provided with a sound hole (17) to resonate vibrations induced in a string (13) strung over at least part of the resonator (3). Within the resonator (3) there is mounted a plate member (19) in a downwardly inclination disposition relative to the belly (5) to divide the interior of the resonator (3) into at least two chambers (21, 23) connected to each other in a region forwardly of a free edge of the plate member (19) to form a sound bell of a width continually increasing towards the sound hole (17) for amplifying low frequency tones and improving bass resonance of the vibrations of the string (13) in the resonator (3).

21 Claims, 4 Drawing Sheets

STRING INSTRUMENT WITH SOUND AMPLIFICATION

BACKGROUND OF THE INVENTION

1. Field of the Invention

The invention, in general, relates to a musical string instrument of the kind usually having a resonator with at least one sound hole therein, a finger board and strings extending across at least a part of the resonator and along the finger board and, more particularly, to a plucked string instrument provided with a sound and bass response amplification device.

2. Brief Discussion of the Prior Art

Plucked string instruments, such as, for instance, guitars, lutes, sitars, mandolins and the like are based upon the same operating principle. Strings are strummed or plucked and, by way of a bridge positioned on the belly or top of the instrument, induce vibrations in a resonant body. At the lower end of the resonant body, one end of the strings is fastened to a tail-piece or directly to the bridge, and thence they extend across the bridge to a neck at the end of which their other end is fastened to a tuning mechanism, such as tuning pegs or the like rotatably mounted in a peg-box for tuning the strings by setting their tension. Basically, the resonant body, also known as a resonator, is no more than a box provided with a sound hole. The principle, which over the centuries until the present has changed little, is acoustically limited as regards deliverable sound volume and bass response, because, physically, practically no sound amplifying components are incorporated in the resonator.

Any desire for higher sound volumes and an improved bass response has been accommodated by increasing the size of the resonators. However, while that does result in greater sound volume and improved bass response, it also leads to a deterioration in the higher frequency response.

In connection with wind instruments, it is known to place bells forwardly of the sound source. Such means are, however, unsuitable for plucked string instruments. Only a violin incorporating a bell or funnel has become known, but it appears not to have met with any success and may be considered to be more of a curiosity than being of any practical use.

OBJECTS OF THE INVENTION

It is an object of the present invention to provide a device for increasing the sound volume and improving the bass response of string instruments in general and plucked string instruments in particular, without requiring an enlargement of their resonators.

Another object of the invention is to provide a string instrument of the kind equipped with a resonator with a sound amplification and bass resonance improving device which does not require an external power source of any kind.

Other objects will in part be obvious and will in part appear hereinafter.

SUMMARY OF THE INVENTION

Briefly, the invention provides for a string instrument of the kind referred to supra having an intermediate plate mounted in the interior of its resonator at a predetermined inclination relative to the belly.

While the device may be mounted, or retrofit ted in the resonator body of any string instrument without requiring any alteration in the shape of the body in respect of either its size or appearance, it is at present the preferred practice of the invention to utilize such intermediate plate in a plucked string instrument. The instrument may, therefore, be played in the usual manner, and it does not suffer from a deterioration of its high frequency response as a result of the device in accordance with the invention. Moreover, by allowing the size of such instruments to be made relatively smaller, the consumption of rare woods otherwise used for their manufacture may be reduced while the same sound quality is maintained.

The radiation resistance to the vibrating air molecules may be adjusted, and bass and resonance may be altered, by the size and/or cross section of the sound hole or holes. By using different sound pervious sound hole covers, a musician may adjust the sound of the instrument to suit his personal taste. To prevent additional standing sound waves in the resonator which reduce the sound volume and cancel each other, a sound hole may be positioned in the side to the right and to the left of the neck joint or button.

The sound of the instrument depends upon its length, thickness and material as well as upon the angle of inclination of the intermediate plate and also upon the size of the sound holes. Using intermediate plates made of diagonally glued layers, i.e. layers the grain structure of which intersects at a predetermined angle, has been found to result in an excellent diagonal distribution of sound waves within the instrument. The sound waves are pushed toward the center of the intermediate plate and positively affect its resonant frequency. In order harmonically to integrate the resonant frequency of the intermediate plate into the overall sound, the intermediate plate preferably is of a length substantially equal to twelve frets (one octave). The position of the intermediate plate in the area of its freely vibrating edge remains open and affects the mutual harmonization of the upper and lower resonance chambers.

BRIEF DESCRIPTION OF THE SEVERAL DRAWINGS

The novel features which are considered to be characteristic of the invention are set forth with particularity in the appended claims. The invention itself, however, in respect of its structure, construction and lay-out, as well as manufacturing techniques, together with other objects and advantages thereof will be best understood from the ensuing description of preferred embodiments when read in conjunction with the appended drawings, in which:

DETAILED DESCRIPTION OF THE DIFFERENT EMBODIMENTS

Figure 1:
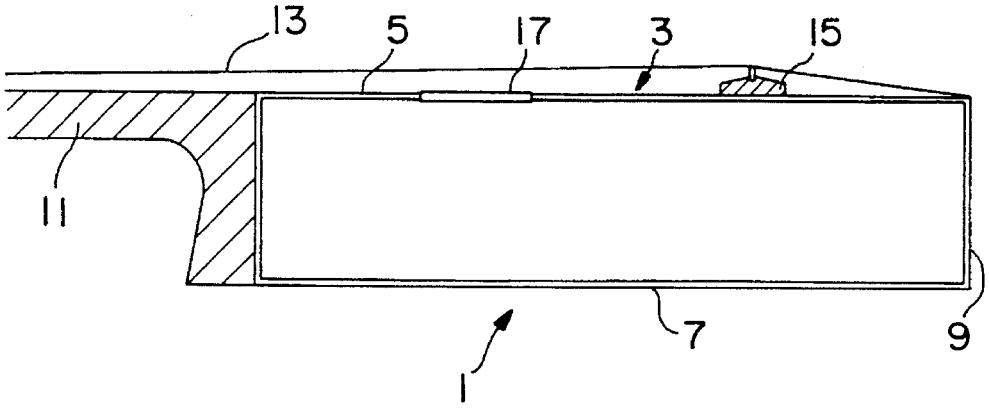
FIG. 1 PRIOR ART
FIG. 1 is a view in longitudinal section of a resonator of a schematically depicted conventionally constructed plucked string instrument.

In the schematic presentation in FIG. 1 of a plucked string instrument 1 the rectangularly depicted resonator thereof is identified by reference numeral 3. It consists of a top or belly 5 and a back 7 connected to each other by a rib or side 9 of conventional bouted configuration. At the left side, there are shown a portion of the neck 11 of the instrument with its fingerboard 12 and its button or connection to the side 9. The end of the neck 11 with its tuning devices has not been shown; only one string 13 is shown to extend across a bridge 15 mounted on the belly 5 and is fastened at a margin thereof. Furthermore a sound exit aperture 17, also called sound hole, is visible in the belly 5. For the sake of simplicity, all reinforcements used to lend structural strength to the instrument, have been deleted from the schematic presentation. The basic structure of the instrument shown in FIG. 1 corresponds to most plucked and bowed string instruments used today.

A sound may be generated by plucking the string 13. The vibrations of the string 13 thus induced are transmitted to the belly 5 by way of the bridge 15. The belly 5 functions as a vibrating diaphragm which emanates the sound into the interior as well as to the exterior of the instrument. The sound emitted to the exterior is acoustically not amplified and, therefore, it contains essentially only high frequency components which require no special resonance. The sound emitted to the interior is amplified by the resonance characteristics of the resonator 3 and exits to the exterior through the sound hole 17. Amplification of the low frequencies in particular and, hence, of low tones, depends upon the size of the resonator 3. In instruments of small volume, such as mandolins, it is very small, in double basses it is correspondingly much greater, with high notes suffering because of the size of the body.

Figure 2:
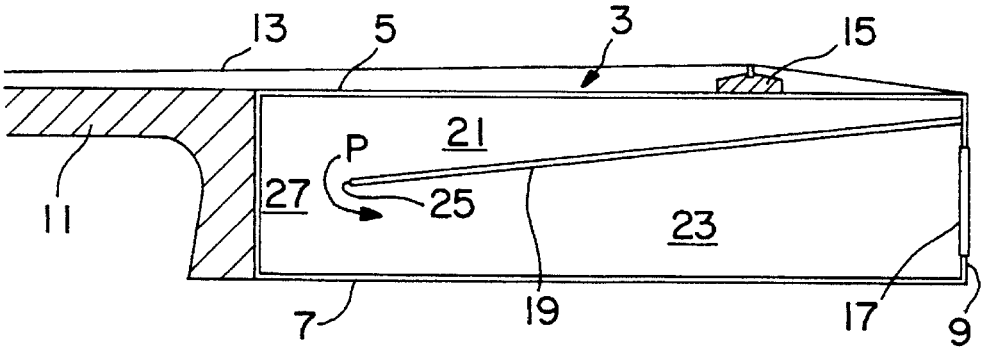
FIG. 2 is a view in longitudinal section of a resonator of a schematically depicted plucked string instrument incorporating an intermediate plate for improving its bass response.

In the schematic presentation of FIG. 2 of the resonator 3 of a plucked string instrument 1 in accordance with the invention, an intermediate plate 19 is mounted within the resonator 3 at an inclination toward the back 7 and toward the belly 5. The intermediate plate 19 is of substantially planar configuration and extends only partially across the cross-section of the side 9. It divides the interior of the resonator 3 into two interconnected chambers 21 and 23 of increasing width. In the example shown, the intermediate plate 19 is connected to the side 9 opposite the neck 11 of the instrument. Its connection to the side 9 at the lower block is very close to the belly 5. Preferably, the intermediate plate 19 is shaped to conform precisely to the internal contour or bouts of the side 9 and is connected, e.g., glued, thereto. Only the forward edge 25 which terminates at the side of the instrument near its neck 11 at some distance from the side 9, is unattached. The open passage between the forward edge 25 and the side opposite therefrom constitutes a connecting region 27 between the two widening chambers 21 and 23 and in a manner of speaking thus form two interconnected sound bells. They could also be referred to as a folded-over bell. A sound hole 17 is provided in the side 9 in that region where the chamber 23 is highest, i.e., at the end of the lower bell. In contrast to conventional instruments, the sound hole is not positioned in,the belly 5 but in the side 9, instead.

By plucking the string 13, or by rubbing it with a bow, the belly 5, by way of the bridge 15 is caused to vibrate and will directly emit the high tones to the exterior, in the accustomed manner and at the usual quality. The lower frequency tones will be deflected into the interior of the resonator 3 and will initially be amplified by the widening upper chamber 21. From there they will be guided in the direction of arrow P into the lower chamber 23 where they will be amplified further before they exit to the exterior through the sound hole 17 located at the end of the lower chamber 23.

Figure 3:
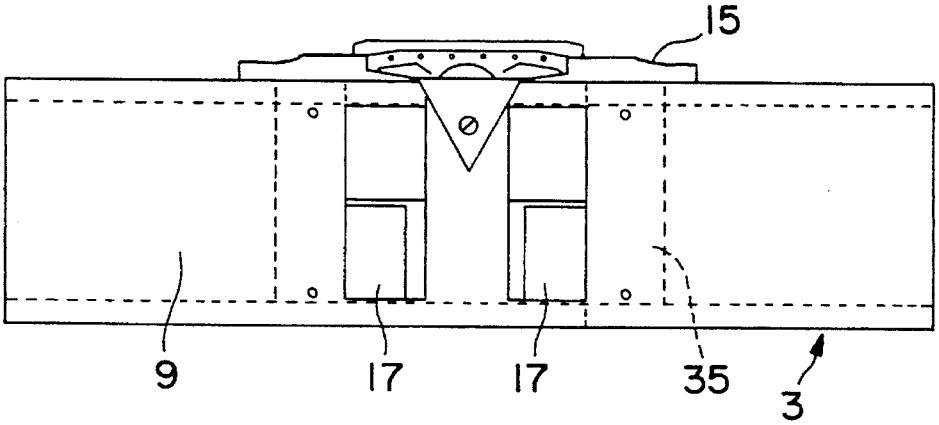
FIG. 3 is a view of a schematically depicted plucked string instrument having two sound holes formed laterally of a lower block divided into sections.
Figure 4:
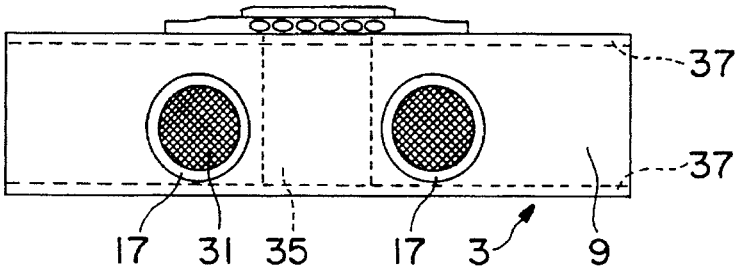
FIG. 4 is a view of a plucked string instrument having two sound holes formed laterally of the lower block.
Figure 5:
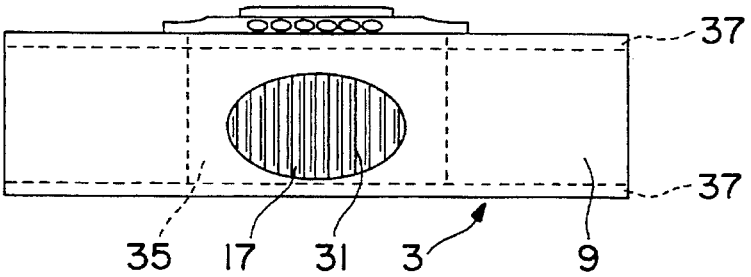
FIG. 5 is a schematically depicted plucked string instrument having one sound opening.

Neither the intensity and nor the timbre of the high frequencies emanating from belly 5 to the exterior are altered as a result of the intermediate plate 19 located in the interior of the resonator 3. The low tones are, however, significantly amplified by the novel quasi bell-shaped structure of the interior of the body 3, resulting in a broader sound spectrum of the instrument and louder or stronger deep tones. The sound hole 17 in the side 9 may be shaped in the same way as those located in the belly 5 of conventional instruments. As shown in FIG. 5, the sound hole 17 is of oval configuration. It may be covered by a grid or by a perforated web 31. Instead of a single sound hole 17, two correspondingly smaller holes 17 may be provided as shown in FIGS. 3 and 4. The size of the sound holes 17 depends upon size and configuration of the resonator 3.

FIGS. 3 to 6 depict, in broken lines, the lower block 35 and two linings 37 (Reifen) the significance of which will be explained in greater detail in connection with the description of FIG. 7. FIG. 7 is a longitudinal section through a plucked string instrument 1 showing the position of the two linings 37 as well as of the lower and upper end blocks 35 and 45. Furthermore, for reinforcing the back 7 and the belly 5, bars 39 and 41 are respectively glued thereto. In contrast to the arrangement shown in FIGS. 1 and 2, the strings 13 extend no further than the bridge 15 to which they are fastened. Furthermore, for transmitting forces from the bridge 15 to the belly 5, a beam 43, not unlike a bass bar, is placed beneath the latter.

FIG. 7 clearly shows the rear end of the intermediate plate 19 to extend directly to the upper lining 37 and is connected to the side 9 in intimate engagement therewith. The connecting region 27 may be limited by arms of the upper block 45 extending obliquely relative to the belly 5 and back 7, thus providing a stepless transition from the upper chamber 21 to the lower chamber 23.

Figure 6:
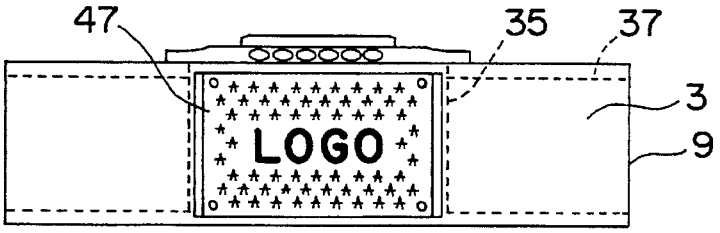
FIG. 6 is a view in longitudinal section of a guitar incorporating an intermediate plate.
Figure 7:
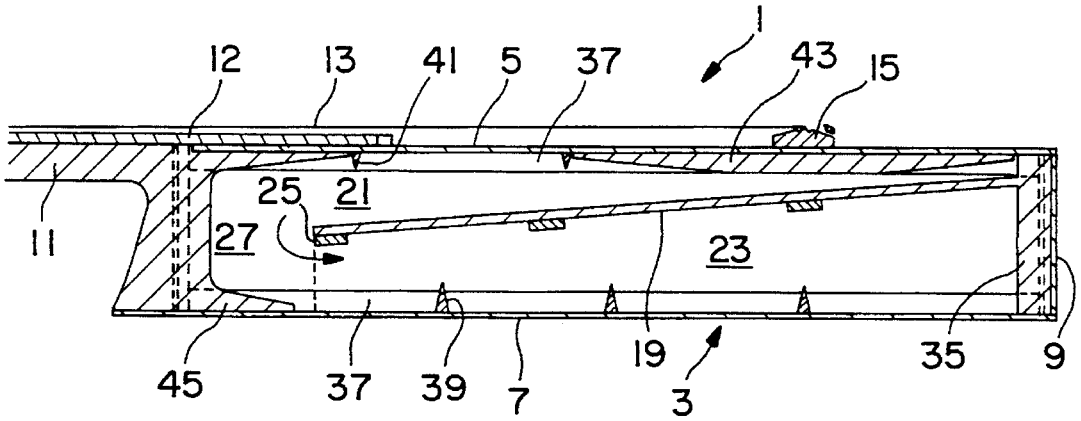
FIG. 7 is a view of a plucked string instrument having a cover placed over its sound hole.

In FIG. 6, the sound hole is completely covered by a cover plate 47. The latter may be provided with a printed-on or perforated logo.

Figure 8:
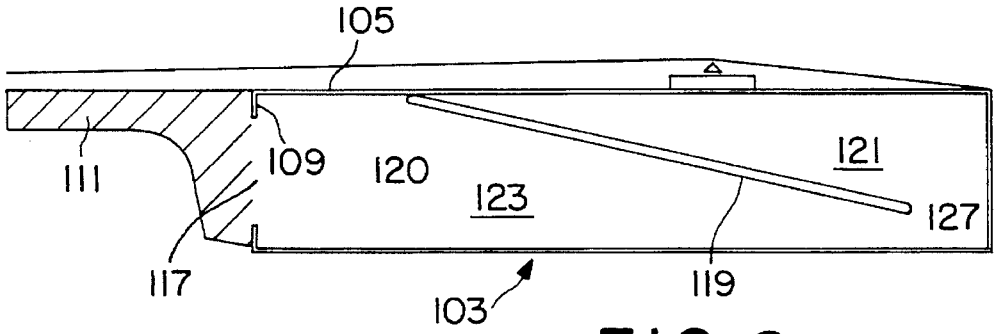
FIG. 8 is a view in longitudinal section of a resonator incorporating an intermediate plate and having a sound hole in the side adjacent the finger board.

In a second embodiment of the invention shown in FIG. 8, an intermediate plate 119 is mounted within the resonator 103. In this embodiment, the root, i.e. the fastened edge, 120 of the intermediate plate 119 does not originate directly at the side 109, but is mounted to the belly 105 directly at some distance from the neck 111 of the instrument. As in the first embodiment, two chambers 121 and 123 are formed which are connected to each other by a connecting region 127 adjacent the lower block. Low tones emanate through two sound holes 117 positioned in the side 109 laterally of the neck 111 of the instrument.

Figure 9:
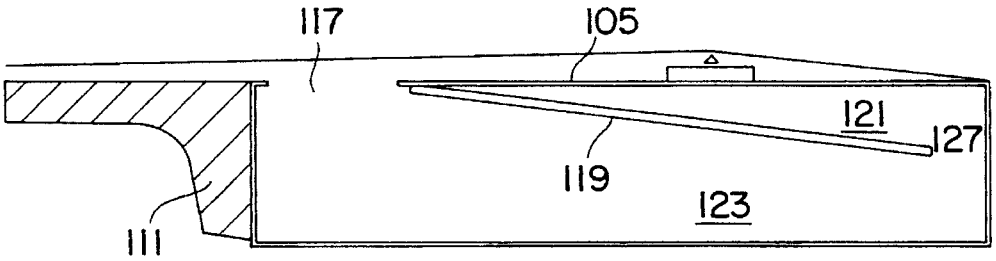
FIG. 9 is a view in longitudinal section of a resonator having a sound hole in its belly adjacent the finger board.

In a similar embodiment of the invention shown in FIG. 9, in which the intermediate plate 119, similar to the embodiment of FIG. 8, is affixed to the belly 105, the sound hole 117 is positioned in the belly 105 at an extension of the fingerboard. Furthermore, in this embodiment the connecting region is placed higher because of a lesser inclination of the intermediate plate 119, resulting in an upper chamber 121 which is smaller relative to the lower chamber 123.

Figure 10:
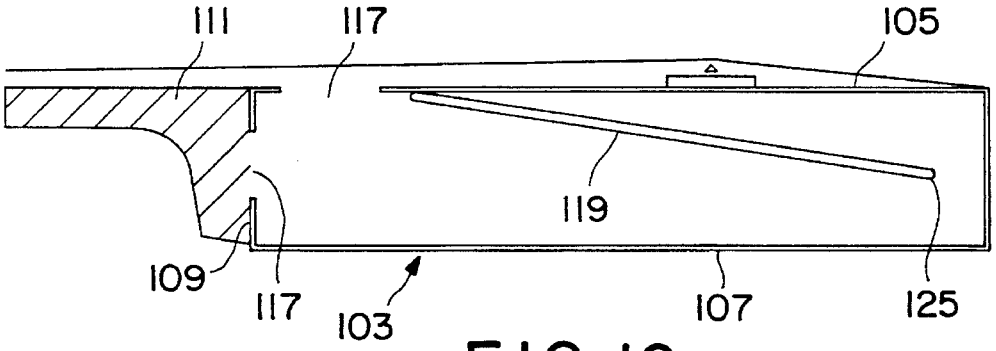
FIG. 10 is a view in longitudinal section of a resonator having two sound holes adjacent its finger board.

In the embodiment of a plucked string instrument shown in FIG. 10, the forward edge 125 of the intermediate plate 119 is positioned substantially halfway between the belly 105 and the back 107 of the resonator 103. As an alternative to a sound hole 117 in the belly 105 or in the side 109, in this embodiment sound holes 117 are provided at both positions. In the three embodiments of FIGS. 8 to 10, the intermediate plate 119, except for its forward edge 125, is directly glued to the belly 105 and to the side 9.

In the embodiment of the resonator 203 shown in FIGS. 11 to 14, the intermediate plate 219 is affixed to the upper block 245 and/or to a connecting brace or bar 246 which may, but need not, be provided, and extends at a downward inclination toward the lower block 235. Hence, in this embodiment, the intermediate plate 219 only indirectly engages the belly 205. With smaller instruments, it would be possible to provide a further, yet curved transverse brace 248 (vide FIG. 13)

Figure 14:
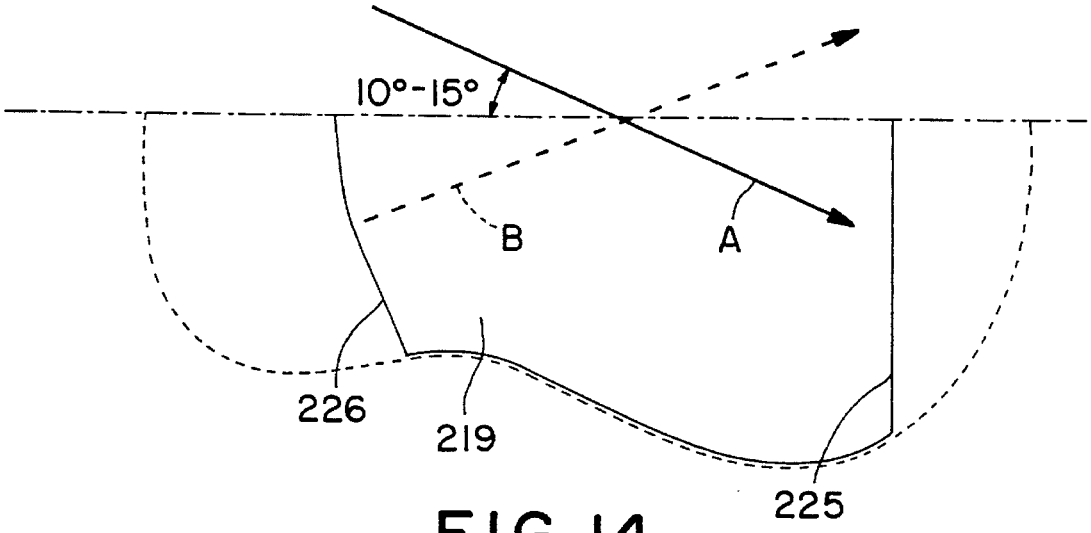
FIG. 14 is a schematic presentation of the attempted flow of sound in the intermediate plate through the direction of the grain of its two laminated sections in accordance with FIG. 13.

The intermediate plate 219 is made up of two superposed layers 220 adhesively laminated together. Two things are accomplished by the lamination: First, transverse stability is imparted to the intermediate plate, thus eliminating the need for reinforcement bars of the kind provided in the embodiment of FIG. 7, and, secondly, its thickness may be chosen to accommodate given tonal requirements without, as would be the case with a solid plate, giving rise to tensions in the intermediate plate which can lead to cracks. To yield the greatest possible dimensional strength, the direction of the grain of the wooden layers is preferably arranged to extend at an angle of 10° to 15° relative to the longitudinal axis of the instrument, or 20° to 30° relative to each other. Not only does such an arrangement yield an intermediate plate 119 of high stability, but it also affects favorably the propagation of sound waves in the intermediate plate 119. In FIG. 14, the arrow A depicts the direction of the grain in the upper layer of the plate, and arrow B depicts the direction in the lower layer of the plate.

Figure 11:
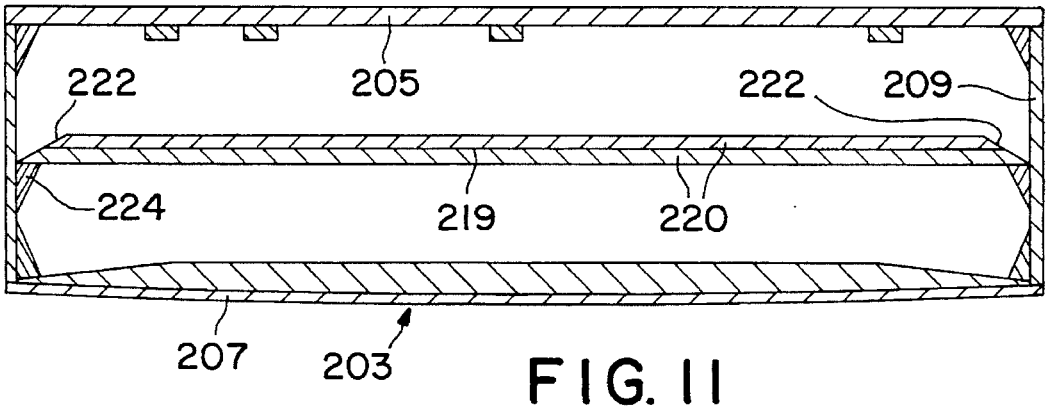
FIG. 11 is a cross-sectional view of the resonator of FIG. 10 along line XI—XI in FIG. 12.
Figure 12:
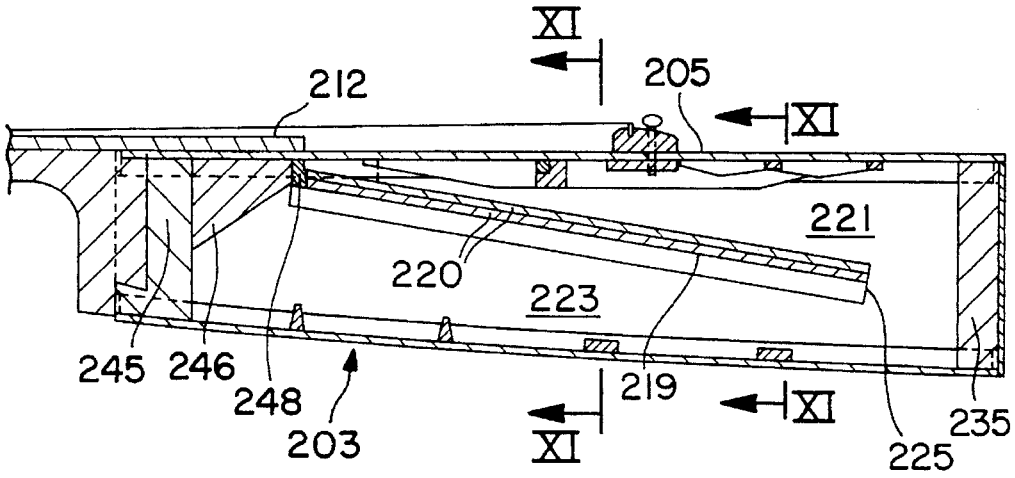
FIG. 12 is a view in longitudinal section of a resonator of a further embodiment of the invention.
Figure 13:
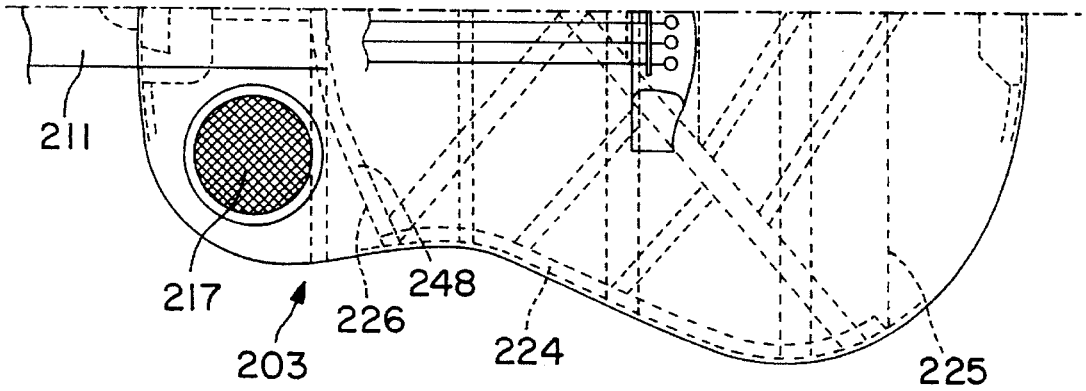
FIG. 13 is a top view of the resonator shown in of FIG. 12.

The cross-sectional view of FIG. 11 depicts the arrangement of a connection between the intermediate plate 219 and the side 209. The margins 222 of the intermediate plate 119 intended to engage the side 209 are beveled at a sharp angle and touch the side 209 substantially along a line. However, in order to provide a flawless stable connection between the intermediate plate 219 and the side 209 a lining 224 of triangular cross-section is glued to the latter and supports the intermediate plate 209 on the shorter one of its surfaces. The belly 205 and the back 207 are connected to the side 209 in a similar fashion. In the plan view of FIG. 13 and in the presentation of FIG. 14 the connecting line 226 between the upper edge of the intermediate plate 219 and the belly 205 may be seen. The position of the forward edge 225 of the intermediate plate 119 may also be seen. One of the two sound holes 217 placed laterally of the extension of the fingerboard 212, is also clearly visible. The fingerboard 212 is glued to the neck 211 and extends over a portion of the upper area, i.e., the belly, of the resonator 203. The sound hole may be open, or it may be covered by a mesh or grid.

The intermediate plates 19, 119, 219 may be made of wood, e.g., spruce or pine, metal, e.g., aluminum, or of a carbon reinforced polymer. The sound of the instrument 1 may be significantly altered by the material chosen for the intermediate plate 19, 119, 219.

As an alternative to a single intermediate plate 19 in a resonator 3, it is possible to utilize more than one, thereby extending the length or increase the size of the sound bell. The intermediate plate 19 may also be mounted at an inclination relative to the longitudinal axis of the instrument 1.

While the invention has herein been described with particular reference to plucked string instruments, it will be apparent to those skilled in the art that it may be generally applicable to any string instrument equipped with a resonator in which an intermediate plate of the kind described infra may be mounted.

It will also be understood by persons skilled in the art that certain changes and modifications may be made in any of the embodiments herein described, without departing from the scope or spirit of the invention. It is, therefore, intended that all matter herein described is to be interpreted as being exemplary only, and in no way as limiting the scope of protection sought.

What is claimed is:

1. A musical string instrument, comprising:

means defining a resonator comprising belly means and back means connected by side means and provided with at least one sound hole;

means for supporting at least one string adapted to be vibrated;

means for transmitting vibrations induced in said string to said resonator; and amplifier means comprising a single substantially planar member mounted in said resonator to extend at a downward inclination relative to said belly means to divide said resonator into two chambers and having a substantially free edge for forming connecting passage means between said two chambers.

2. The instrument of claim 1, wherein said planar means is of a length, measured between its free edge and an edge opposite therefrom, of about twelve frets (one octave).

3. The instrument of claim 1, wherein said lateral edges of said planar means extending from the free edge thereof are connected to said side means in intimate engagement therewith.

4. The instrument of claim 3, wherein said planar means is mounted in said resonator by attachment of its edge opposite its said free edge to said side means.

5. The instrument of claim 3, wherein said planar means is mounted in said resonator by attachment of its edge opposite its said free edge to said belly means.

6. The instrument of claim 3, wherein said resonator is further provided With transverse brace means attached to said belly means and wherein said planar means is attached to said transverse brace means.

7. The instrument of claim 3, wherein said side means is provided with lining means and wherein said lateral edges of said planar means are supported by said lining means.

8. The instrument of claim 1, wherein said planar means comprises a laminate of at least two wooden layers.

9. The instrument of claim 8, wherein said wooden layers have a grain structure of predetermined direction and wherein said layers are adhesively laminated with the direction of their respective grain structures intersecting at an angle of between 10° and 20°.

10. The instrument of claim 1, wherein said sound hole is provided in said side means.

11. The instrument of claim 1, wherein said sound hole is provided in said belly means.

12. The instrument of claim 11, comprising a second sound hole in said side means.

13. The instrument of claim 1, further comprising neck means connected to said resonator and having fingerboard means extending over a portion of said belly means, wherein one sound hole each is provided in said belly means on opposite sides of said fingerboard means.

14. The instrument of claim 1, further comprising block means including upper and lower block means mounted in said resonator and wherein at least one sound hole is provided adjacent at least one of said upper and lower block means.

15. The instrument of claim 14, wherein at least one sound hole is provided on opposite sides of at least one of said upper and lower block means.

16. The instrument of claim 1, wherein said sound hole is covered by sound pervious cover means.

17. The instrument of claim 13, wherein said planar means comprises further edge means opposite its said free edge, said further edge means being positioned in said resonator adjacent said neck means.

18. The instrument of claim 1, wherein said means for transmitting vibrations comprises bridge means in contact with said belly means and said string means.

19. The instrument of claim 1, wherein said at least two chamber means forms folded-over bell means of a width increasing in the direction away from the mounting of said planar means and wrapping around said free edge of said planar means.

20. The instrument of claim 1, wherein said vibrations are induced in said string means by the plucking thereof.

21. A musical string instrument, comprising:

means defining a resonator comprising belly means and back means connected by side means and provided with at least one sound hole;

means for supporting at least one string adapted to be vibrated;

means for transmitting vibrations induced in said string to said resonator; and amplifier means comprising a single substantially rigid planar member mounted in said resonator to extend in a downward inclination relative to said belly means to divide said resonator into two interconnected chambers and having a substantially free edge for forming connecting passage means between said two chambers, said planar means being adapted substantially to withstand vibrating.

* * * * *